US005317370A

United States Patent [19]

Kohyama et al.

[11] Patent Number: 5,317,370

[45] Date of Patent: May 31, 1994

[54] DEVELOPING APPARATUS INCLUDING MEANS FOR COLLECTING USED DEVELOPING AGENT

[75] Inventors: Mitsuaki Kohyama, Tokyo; Kazuhiko Kikuchi; Naruhito Yoshida, both of Yokohama; Minoru Yoshida, Tokyo; Kouji Hirano, Yokosuka, all of Japan

[73] Assignee: Kabushiki Kaisha Toshiba, Kawasaki, Japan

[21] Appl. No.: 989,520

[22] Filed: Dec. 11, 1992

[30] Foreign Application Priority Data

Dec. 13, 1991 [JP] Japan ..... 3-329306

[51] Int. Cl.[5] ..... G03G 15/06

[52] U.S. Cl. ..... 355/245; 118/652; 355/270

[58] Field of Search ..... 355/245, 246, 259, 260, 355/269, 270; 118/652, 653

[56] References Cited

U.S. PATENT DOCUMENTS

| | | | |
|---|---|---|---|
| 3,152,012 | 10/1964 | Schaffert et al. | 118/637 |
| 3,731,146 | 5/1973 | Bettiga et al. | 317/3 |
| 3,866,574 | 2/1975 | Hardennrook et al. | 118/637 |
| 3,893,418 | 7/1975 | Liebman et al. | 118/637 |
| 5,132,734 | 7/1992 | Momiyama et al. | 355/245 X |
| 5,146,285 | 9/1992 | Kikuchi et al. | 355/270 |
| 5,166,472 | 11/1992 | Maeda et al. | 118/653 |
| 5,177,323 | 1/1993 | Kohyama | 118/653 |

FOREIGN PATENT DOCUMENTS

| | | | |
|---|---|---|---|
| 47-13088 | 7/1972 | Japan . | |
| 47-13089 | 7/1972 | Japan . | |
| 0010274 | 1/1985 | Japan | 355/260 |
| 0129366 | 6/1988 | Japan | 355/260 |

*Primary Examiner*—A. T. Grimley
*Assistant Examiner*—William J. Royer
*Attorney, Agent, or Firm*—Foley & Lardner

[57] ABSTRACT

A transfer roller is provided near a developing roller which is set, at a relative speed of substantially zero, in contact with a photosensitive drum to develop an electrostatic latent image on the photosensitive drum into a visual image. A toner transfer roller supplies a toner, that is, a one-component developing agent which is stored in a toner storage section to the developing roller and receives that toner which is unspent upon development from the developing roller. The unspent toner transferred to the toner transfer roller is brought into abutting contact with a mesh network of a toner separating member to separate the toner from the toner transfer roller over a predetermined effective length. By so doing it is possible to erase a developing hysteresis from the developing roller and, at the same time, collect the toner back into the toner storage section so that the collected toner is mixed with a fresh toner for use at the next developing cycle.

2 Claims, 5 Drawing Sheets

DEVELOPING APPARATUS INCLUDING MEANS FOR COLLECTING USED DEVELOPING AGENT

BACKGROUND OF THE INVENTION

1. Field of the Invention

The present invention relates to a developing apparatus for developing a visual electrostatic latent image on an electronic photographing or an electrostatic recording apparatus and, in particular, a developing apparatus capable of obtaining a high-quality image using a one-component developing agent.

2. Description of the Related Art

In recent years, a developing system using a one-component developing agent has been reduced to practice.

This system, as distinct from a system using a two-component developing agent comprised of a toner and carrier, does not require any developing agent carrier, magnet roller, toner density control device, etc. and can be made compact and low in cost.

Conventionally, impression development has been known as one of the developing methods using a one-component developing agent.

This method is disclosed in U.S. Pat. No. 3,152,012, U.S. Pat. No. 3,731,146, Published Unexamined Japanese Patent Application 47-13088 and Published Unexamined Japanese Patent Application 47-13089, in which a toner carrier having a toner (developing agent) layer formed thereon is set in contact with an electrostatic latent image on a drum at a relative peripheral speed of substantially zero.

The method above ensures a compact apparatus of a simpler arrangement and better toner color development, because it is not necessary to employ a magnetic material.

In compression development, since the toner carrier is set in contact, or pressure contact, with the electrostatic latent image on the drum surface, it is necessary to use a developing roller of proper elasticity and conductivity as the toner carrier. In particular where the electrostatic latent image carrier is comprised of a rigid body, it is necessary that the developing roller be made of an elastic body so as to prevent any injury to the rigid body.

U.S. Pat. No. 3,866,574, U.S. Pat. No. 3,893,418 and other prior art disclose a non-contacting type developing method as the one-component type developing method.

In this method, a developing agent layer is set in proximity to an electrostatic latent image on a drum and development is made by the flying of the toner at the latent image with an AC field applied across the developing agent layer and the latent image. In this case, it has been usual to form a developing roller as a rigid body.

In the one-component developing method it is generally known that an image defect emerges due to a hysteresis image called a "sleeve ghost."

The "sleeve ghost" is caused primarily by the toner layer formation quality at the time of forming a toner layer on the developing roller. Unless the thickness of the toner layer, the amount of charges involved, etc., at some area, are the same as those at other areas before one toner-transferred area on the electrostatic latent image side is again used in the next development cycle, there occurs a hysteresis density difference between these two areas.

A new problem arises in the case where the developing apparatus is applied to the so-called developing/-cleaning process (cleanerless process). That is, a foreign substance, such as paper dust, separated from a transfer sheet, upon cleaning, together with the collected developing agent is mixedly returned back into the developing apparatus. In this case, the foreign substance accumulates on the developing roller (developing agent conveying means) so that the developing agent is not properly electrically charged. This poses a problem. The apparatus involved must be replaced with a new one or cleaned due to image defects in spite of the presence of the developing agent.

In the prior art, a fairly good solution has been proposed, as will be set out below, in the case where the developing apparatus is used as an independent apparatus.

(1) A scraping member, such as a blade or a sponge roller, is set in contact with the developing roller to scrape all residual toner off the developing roller, so that any hysteresis difference as already set out above is removed.

(2) A bias voltage is applied to, for example, a conductive roller, etc., at which time the conductive roller is moved near the developing roller to separate the toner off the whole surface of the developing roller.

In either case, after the development of the toner, the residual toner is temporarily separated off the whole surface of the roller, so as to erase a hysteresis difference resulting from a development pattern. This approach is reasonable, taking the cause of that phenomenon into consideration.

These approaches still involve some problems to be solved.

Setting a member, such as a blade, in abutting contact with the developing roller is not desirable from the standpoint of its service life, because the injury of the developing roller, sticking of some toner on the roller surface, etc. are involved. These defects are particularly prominent in the case where an elastic roller comprised of rubber or resin is used as the developing roller. From this, it is considered preferable to employ a roller-like scraping member as a separation member for separating the developing agent from the elastic developing roller. In spite of such a countermeasure it has been found that irregularities and fogging sometimes occur on an image on the drum surface after 1000 to 2000 copies have been printed out.

As a result of investigations into such a cause, it has been found that, since the separated developing agent is gradually accumulated at an area near the developing agent separation member and a fresh developing agent and once-charged unspent developing agent (collected developing agent) are again supplied, in a mixed state, to the developing roller, an image emerges at an uneven density upon development. Such an image defect occurs due to a hysteresis difference between the new and unspent developing agents in the developing apparatus as in the case of the sleeve ghost (hysteresis image) emerging on the developing roller.

It has been found that, in the case where the developing apparatus is employed as the aforementioned developing/cleaning apparatus, not only those developing agents different in their charging hysteresis are again supplied, in the mixed state, for development but also a foreign substance containing a paper dust (talc, kaolin, etc.) is deposited on the developing roller and separation roller with the separation and collection of the developing agent. These situations cause a charging defect of the developing agent and, hence, the apparatus has a shortened service life.

SUMMARY OF THE INVENTION

It is accordingly the object of the present invention to provide a developing/cleaning apparatus which can eliminate a "sleeve ghost" often encountered in a one-component developing system and can prevent an image defect caused by a foreign substance, such as a paper dust, mixed in a collected developing agent in a cleanerless process (developing/cleaning process).

According to the present invention, a developing apparatus for developing a latent image on an image carrier with an one-component developing agent, comprising: first supplying means, in contact with the image carrier, for supplying the developing agent to the latent image on the image carrier and simultaneously removing the developing agent remaining on the image carrier; storing means for storing the developing agent; second supplying means, in contact with the first supplying means, for supplying the developing agent from the storing means to the first supplying means and removing the developing agent remaining on the first supplying means; and removing means, in contact with the second supplying means, for removing the developing agent remaining on the second supplying means and collecting the removed developing agent back into the storing means.

According to the present developing/cleaning apparatus, the developing agent stored in the developing agent storage section is supplied by the developing agent transfer means to the developing agent conveying means. The developing agent supplied to the developing agent conveying means is conveyed to an image carrier side and, at the same time, the developing agent is formed, as a thin layer, on the surface of the developing agent conveying means by the developing agent forming means. When the thin layer thus formed on the developing agent forming mean confronts the imaging area of the image carrier, the developing agent is electrostatically deposited on the latent image on the image carrier to visualize the latent image.

The developing agent on the developing agent conveying means which is unspent upon development is carried back to the developing agent transfer means side so that it is transferred to the developing agent transfer means. With the rotation of the developing agent transfer means, the transferred developing agent is conveyed to the developing agent separating means side where the developing agent deposited on the developing agent transfer means is separated therefrom over the predetermined effective length for collection back into the developing agent storage section. The collected developing agent is mixed with the fresh developing agent for use in the next developing cycle.

Since the unspent developing agent on the developing agent conveying means is once removed therefrom and collected back into the developing agent storage section, it is not conveyed back toward the developing agent layer forming means side. As a result, it is possible to completely erase a developing hysteresis on the developing agent conveying means and hence to perform a better developing operation free from an image defect called "a sleeve ghost."

Even in the case where any foreign substance, such as a paper dust, separated from the transfer sheet is collected together with the unspent developing agent, it is not crowded back toward the developing agent conveying means for dispersion and hence the normal charging of the developing agent by the developing agent layer forming means is not adversely affected, thus preventing any earlier replacement and cleaning of the apparatus as necessitated by the aforementioned image defect in spite of the fact that there is a supply of the developing agent. It is, therefore, possible to optimize the developing/cleaning process (cleanerless process).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

One embodiment of the present invention will be explained below with reference to FIGS. 1 to 4.

Figure 1:
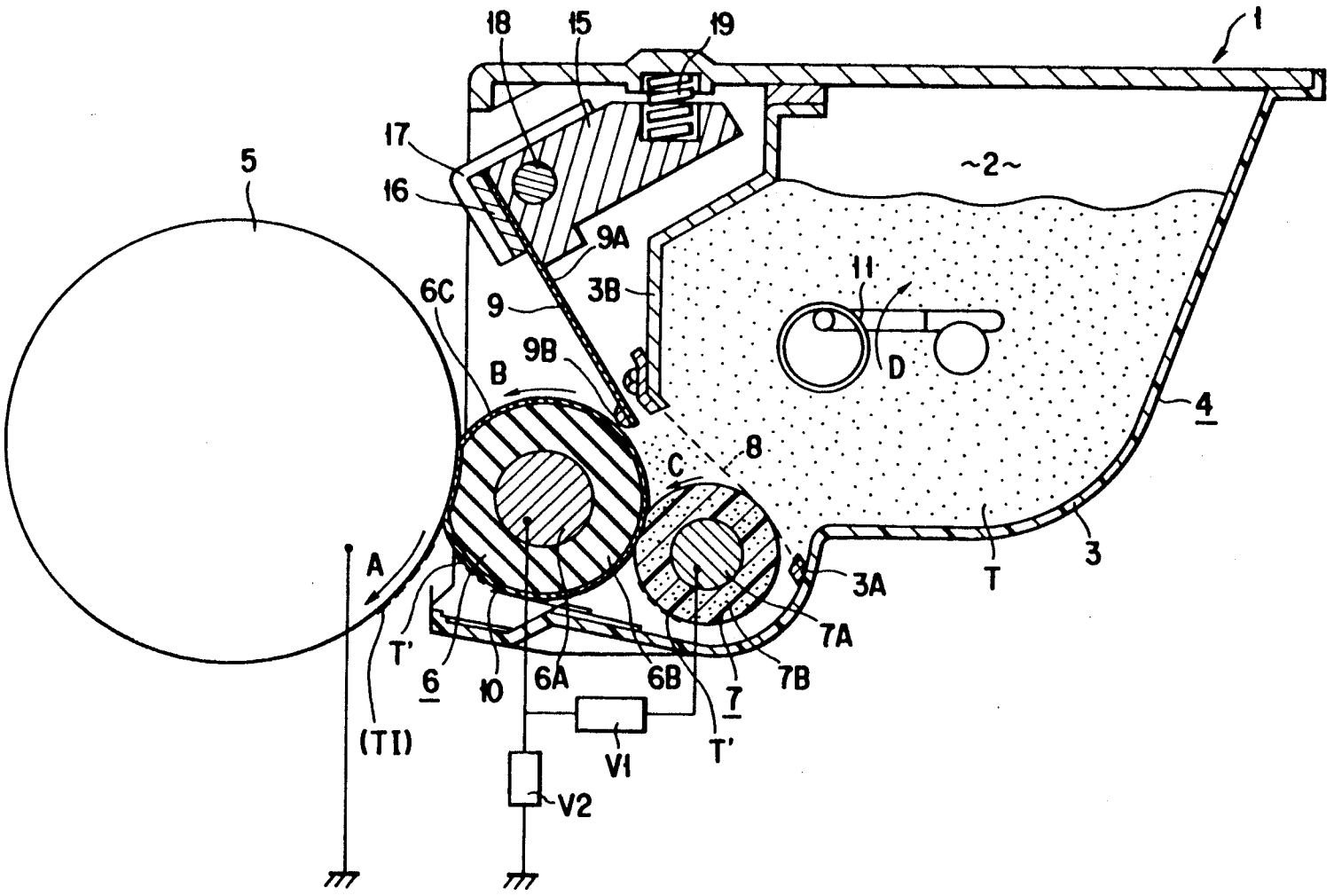
FIG. 1 is a cross-sectional view schematically showing an arrangement of a developing apparatus according to one embodiment of the present invention.

FIG. 1 is a cross-sectional view showing a developing apparatus 1 according to an embodiment of the present invention.

The developing apparatus 1 employs a nonmagnetic toner T (hereinafter referred to as a one-component developing agent) and has an apparatus body 4 formed integral with a toner hopper 3 serving as a developing agent storage section, that is, as a toner storage section 2.

The apparatus body 4 is opened at an area corresponding to a negatively charged organic photosensitive drum 5 serving as an image carrier. In the neighborhood of the open area, a developing roller 6 is provided as a developing agent conveying means. The developing roller 6 is set in contact with the photosensitive drum 5 and adapted to be rotated in the same direction, that is, in a "with" direction (a direction of an arrow B), as a rotation direction (a direction of an arrow A) of the photosensitive drum 5 as viewed at a contacting area between the drum 5 and the developing roller 6.

A toner transfer roller 7 is provided, as a developing agent transfer means, at an area corresponding to a bottom zone of the toner storage section 2 and at the back of the developing roller 6 to effect a transfer of a toner T to the developing roller 6.

At the back of the toner transfer roller 7, a film-like toner separation member 8 is stretched between a holder section 3A fixed to the bottom of the toner hopper 3 and an upper partition plate 3B forming part of the toner hopper 3. The toner separation member 8 serves as a developing agent separation means constituting a mesh network 8D, as will be set out below, and is set in pressure contact with the toner transfer roller 7 in the length direction of, and at the back of, the toner transfer roller 7.

In the apparatus body 4, a blade 9 is set above the developing roller 6 and restricts an amount of toner to be supplied by the developing roller 6 to form a thin layer of the toner T on the surface of the developing roller 6. The blade 9 serves as a developing agent layer forming means for triboelectrically charging the toner T.

Below the developing roller 6, a recovery blade 10 is set in contact with the developing roller 6 and made of polyethyleneterephthalate film. A mixer 11 is provided, as an agitating/moving means, within the toner storage section 2 to move the toner T while agitating the toner T.

The developing apparatus 1 of the present invention has the developing roller 6 as a conductive, elastic developing roller on which the toner T is formed as a thin film, and performs a developing operation through the developing roller set in contact with the surface of the photosensitive drum 5 on which an electrostatic latent image is formed. Therefore, the developing apparatus obviates the necessity for providing any developing agent carrier, magnet roller, toner density control device, etc. and offers a compact, low-cost developing system.

The major component parts of the developing apparatus 1 will be explained below in more detail.

First, the developing roller (developing agent conveying means) 6 will be explained below.

The first requisite property for the developing roller 6 is to possess an electric conductivity and elasticity. The simplest structure for satisfying the requisite property above can be provided as a combination of a metal shaft and conductive rubber roller, but a surface smoothness is required for the toner T to be conveyed while set in pressure contact with the surface of the developing roller 6.

Figure 2:
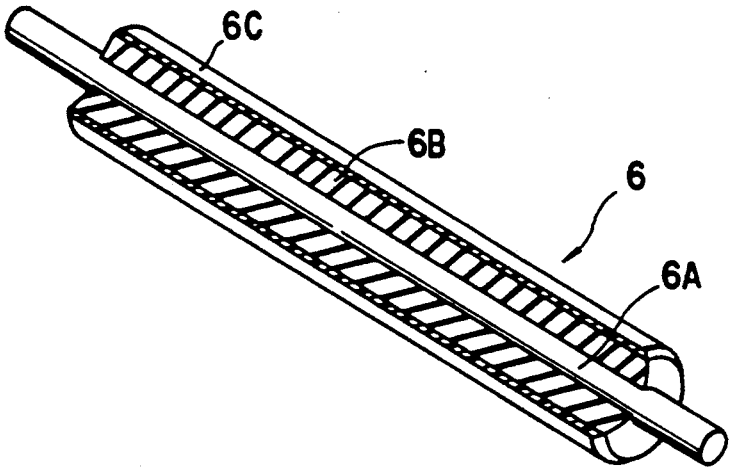
FIG. 2 is a perspective, cross-sectional view showing a developing roller in the developing apparatus of FIG. 1.

According to the present invention, as shown in FIGS. 1 and 2, the developing roller 6 comprises a metal shaft 6A and a double layer around the metal shaft 6A in which case the double layer comprises an elastic layer (inner layer) 6B and a surface conductive layer 6C.

As the elastic layer 6B, a conductive one and nonconductive one may be considered, but the conductive layer is desirable because the conductive layer 6C may be separated from the elastic layer 6B or damaged. As the elastic layer 6B is set in pressure contact with the blade 9 and photosensitive drum 5, the elastic layer, if being great in its rubber hardness, requires a larger load so as to obtain a predetermined nip. This, in turn, results in an increase in torque of the developing apparatus.

Further, a permanent set (%) defined under "JISK6301" arises upon packaging or upon standing for a longer period of time. For the permanent set exceeding about 10%, an image suffers a variation owing to a variation in cycle of the developing roller and, therefore, a compressive strain (%) in the elastic layer 6B need be made below 10% and desirably below 5%. The rubber hardness-to-permanent set relation reveals such a tendency that, normally, the greater the rubber hardness the smaller the permanent set. A trade-off is important relative to the material of which the elastic layer is made.

The developing roller 6, after being deformed by a pressure contact force of the blade 9, allows the toner to be fed to a developing section of the photosensitive drum 5. The developing roller 6, therefore, needs to recover from its deformed state before the development step. This is because the developing roller 6 affects the development step. This is because the developing roller 6 affects the development step if it is in a state. The rubber hardness of the elastic layer 6B is made below 35° and preferably below 30°. On the other hand, the rubber hardness of the conductive layer 6C is made below 35° C. and, preferably, below 30°. The conductive layer 6C is formed by spray-coating the surface of the elastic layer 6B with a conductive urethane-based coating compound or dipping the surface of the elastic layer 6B into the conductive urethane-based coating compound. The conductive layer 6C, being set in direct contact with the toner T and thus the photosensitive drum 5, has to be of such a nature as not to contaminate the toner T and hence the photosensitive drum 5 due to the exudation of a plasticizer, vulcanizer, process oil, etc. therefrom.

The surface smoothness of the conductive layer 6C is made preferably below 3 to 5 μmRz and, for a value exceeding 3 to 5 μmRz, an uneven surface pattern is liable to emerge on an image. It may be considered that, in order to achieve a surface smoothness 3 μmRz of the conductive layer 6C, the conductive layer is finished to a given surface roughness and given diameter after a conductive layer 6C of adequate thickness has been formed on the elastic layer 6B. Then a post-processing (polishing) is done. In order to realize this process at low cost without such post-processing, it is necessary to optimally select the surface roughness of the elastic layer 6B, thickness of the conductive layer 6C and viscosity of the coating compound.

That is, the lower the viscosity of the coating compound and the greater the surface thickness of the elastic layer 6B, the greater the thickness of the surface conductive layer 6C. Upon formation of the conductive layer 6C, the viscosity of the coating compound needs to be varied according to a method by which a coating compound is coated on the surface of the elastic layer 6B, for example, to be varied by varying a dilution level, even if the same coating compound is employed.

For the developing roller 6 to have the requisite properties, use is made of a conductive silicone rubber of a rubber hardness (JIS-A) of below 35°, as elongation of about 250 to 500%, a resistive value of below $1\times10^7$ Ω.cm for the case of the elastic layer 6B. A conductive polyurethane coating compound, such as "Sparex" (a trade name) manufactured by NIHON MIRACTRON CO., LTD., has a resistive value of $10^4$ to $10^6$ Ω.cm and an elongation of about 100 to 400% for the case of the conductive layer 6C, noting that the developing roller 6 as a whole has a rubber hardness of about 30° to 40° and a conductivity of $10^2$ to $10^8$ Ω.cm.

Further, even when a conductive layer 6C about 50 to 120 μm thick, is formed by a spray coating method on the elastic layer 6B whose surface roughness was 5 to 10 μm, it is possible to achieve a developing roller 6 of a surface roughness of about 3 μmRz, and obtain a better image.

In the embodiment above, although the developing roller 6 has been explained as having an elastic layer 6B of conductive silicone rubber formed on metal shaft 6A and surface conductive layer 6C of conductive polyurethane coating compound formed on the elastic layer 6B, use may be made of a developing roller 6 if the elastic layer 6B and surface conductive layer 6C have such properties as to satisfy the aforementioned properties.

The toner transfer roller 7 will now be explained below in more detail.

The toner transfer roller 7 comprises a metal shaft 7A and a flexible, expanded polyurethane foam layer 7B formed around the metal shaft 7A and having a conductivity of below $10^9$ Ω.cm, a density of 0.45 g/cm$^2$ and about 50 to 60 cells per mm. The toner transfer roller 7 is rotated at a rotation rate about 0.5 to 4 times that of the developing roller 6 and in an "against" direction (direction C) opposed to the rotation direction (direction B), noting that the directions of the developing roller 6 and toner transfer roller 7, though being desirably the directions B and C, are not restricted thereto.

By applying the same potential as, or about 100V higher than, that of the developing roller 6 to the toner transfer roller 7 by a bias power source $V_1$, the toner T is moved in better condition, thus assuring a better image.

The material of which layer 7B is formed is not restricted to the flexible, expanded polyurethane foam and can be replaced by many materials having mechanical, electrical or other proper properties, such as an expanded silicone rubber. The bias voltage to be applied to the toner transfer roller 7 is desirably confirmed by experiments and adjusted so as to contribute to a supply of the toner T transferred.

Figure 3:
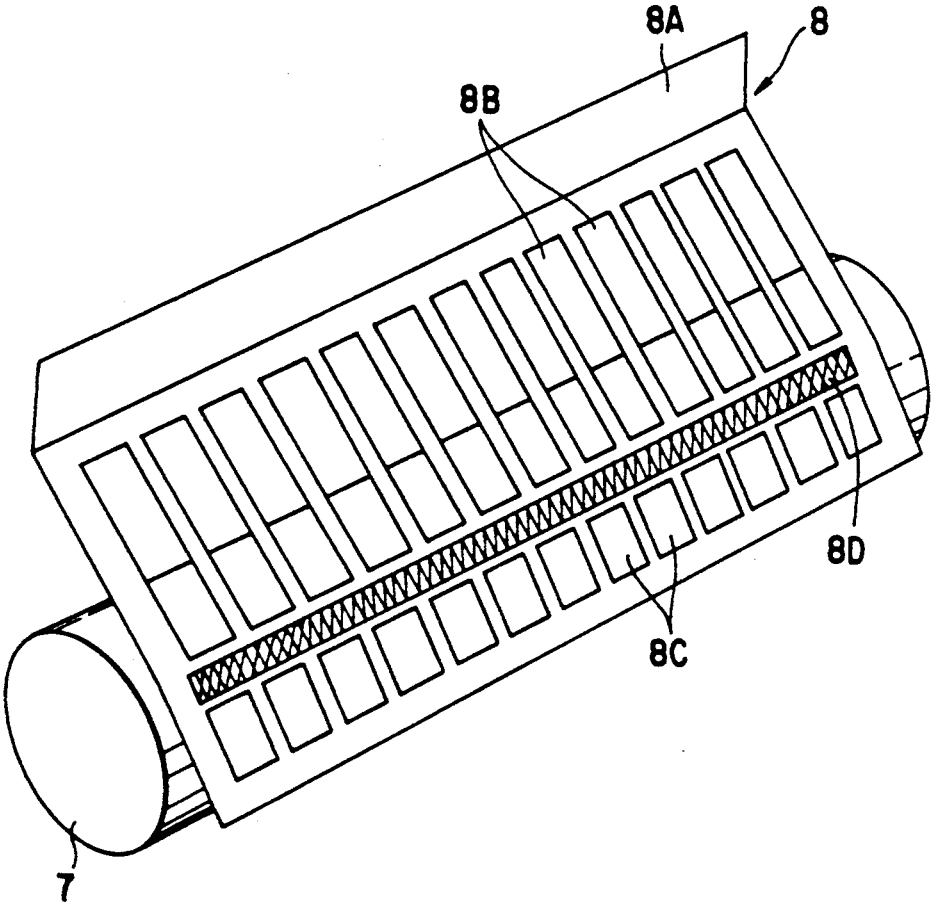
FIG. 3 is a perspective view diagrammatically showing an arrangement of a toner separation member, that is, a major section of the developing apparatus shown in FIG. 1.

The toner separation member 8 will now be explained below with reference to FIG. 3.

The toner separation member 8 has its mesh network 8D set in slide contact with the rotating toner transfer roller 7 and serves to separate the toner T off the surface of the toner transfer roller 7 at the edges of innumerable number f meshes in the mesh network 8D.

The toner separation member 8 has a band-like opening in a film-like member 8A about 0.03 to 0.1 mm thick made of stainless steel, polyester, etc. and the aforementioned mesh network 8D provided as a band-like mesh network and closing the band-like opening. The mesh network 8D is adapted to be set in frictional contact with the toner transfer roller 7 across a width of 2 to 10 mm over a length of the toner transfer roller 7.

The mesh network 8D is made of nylon filaments, stainless lines and steel wires or made up of a multi-slitted network and, in this case, about 50 to 200 meshes are provided for the mesh network 8D. It is preferable that these lines or wires or slit-to-slit areas be very fine. In a practical application, the lines or wires of 10 μm to 50 μm in diameter are easier to use and easier to handle or reset.

At the toner separation member 8, openings 8B, practically large enough to ensure a mechanical strength are provided in a larger number at an upper area of the mesh network 8D and openings 8C practically large enough to ensure a mechanical strength are provided in a larger number at a lower area of the mesh network 8D. The toner T can be moved through these openings 8B and 8C in the toner separation member 8.

The toner separation member 8 as set out above is stretched within the developing apparatus 1 such that the mesh network 8D is set in frictional contact with the toner transfer roller 7, while applying a proper pressure to the toner transfer roller. In this way, that toner layer on the toner transfer roller 7 received from the developing roller 6 is sequentially separated off the surface of the toner transfer roller 6 by the mesh network 8D.

The contacting position of the toner separation member 8 relative to the toner transfer roller 7 will be explained below in more detail.

The toner separation member 8 is placed in contact with the toner transfer roller 7 such that a point of contact between the toner separation member 8 and the toner transfer roller 7 is situated at least more on the upstream side of the toner transfer roller 7 as viewed from the rotational direction of the toner transfer roller 7 then where, at a location nearer than the toner hopper, the toner separation member is set in contact with the toner transfer roller 7 as viewed in a horizontal plane.

Figure 6A:
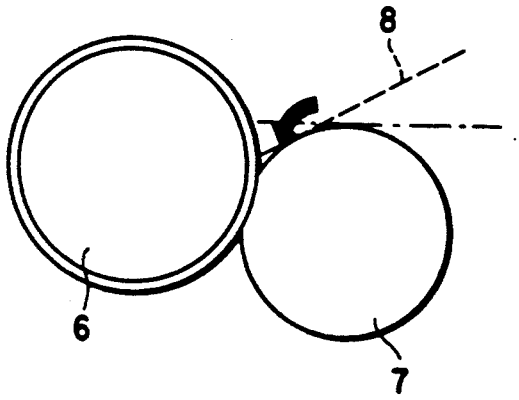
FIGS. 6A to 6D show a direction of a toner flow at an angle at which the toner separation member is mounted.
Figure 6C:
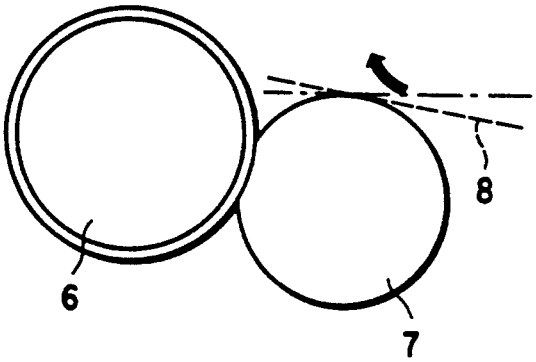
Figure 6B:
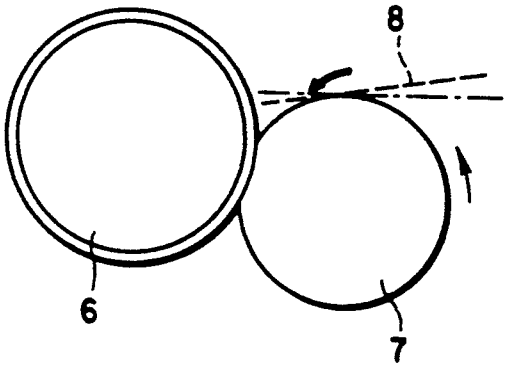
Figure 6D:
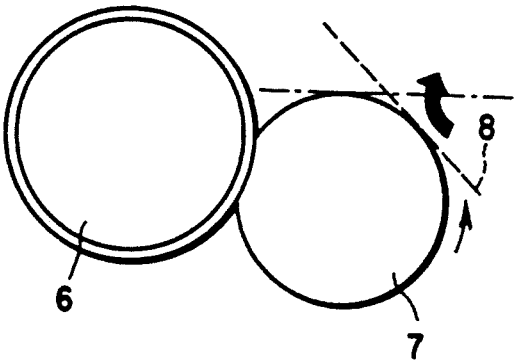

The contacting position above will be explained below with reference to FIGS. 6A–6B.

In FIG. 6, a dash-dot line shows a horizontal line (hereinafter referred to as a horizontal line) corresponding to a ground surface, not shown. The flow of a toner is indicated by black arrows in FIGS. 6A–D. As shown in FIGS. 6A and 6B, if a point of contact between the contact separation member 8 and the toner transfer roller 7 is situated anywhere on the downstream side of the toner separation member 8 as viewed in the rotational direction of the toner transfer roller, the toner separated by the toner separation member 8 is again transported promptly by the toner transfer roller 7 without being moved toward the toner storage section 2. As shown in FIGS. 6C and 6D, if the toner separation member 8 is located such that a point of contact between the horizontal line and the toner transfer roller 7 is situated more on the downstream side than the point of contact between the toner separation member 8 and the toner transfer roller 7 as viewed in the rotational direction of the toner transfer roller, there is no such flow of the toner as to again transport the toner which is separated by the toner separation member promptly toward the toner transfer roller 7. The toner thus separated is moved toward the toner storage section 2 and mixed with the toner in the storage section.

The separated toner T is moved past the meshes of the mesh network 8D and floated at the back of the mesh network 8D. The toner T there is scooped up, little by little, by the mixer 11 rotating in a direction as indicated by an arrow D in FIG. 1 and mixed with another toner T carried into the toner storage section 2.

The toner T separated off the toner transfer roller 7 and then mixed with another toner T is moved past the openings 8B, as the mixer 11 is rotated in a direction of the arrow D in FIG. 1, and again supplied by the toner transfer roller 7 to the developing roller 7 so as to perform development.

In this way, the toner is separated off the toner transfer roller 7, by the mesh network 8D of fine meshes as set out above, while being scooped up from the back of the roller 7 by the mixer 11, and again supplied to the roller 7 past the openings 8B provided above the mesh network 8D.

By so doing it is not necessary to provide any bulkier toner recirculation mechanism required in the prior art and it is possible to completely eliminate a development hysteresis on the developing roller 6.

As evident from the above, the mesh structure of the mesh network 8D may be of a generally known type and can be variously changed or modified without being restricted to the concept "mesh structure."

It has been necessary to experimentally determine, to an optimal value, an abutting pressure between the toner separation member 8 and the toner transfer roller 7, because the abutting pressure contributed to the toner separation characteristic and toner recovery or collection capacity.

The blade 9, that is, the developing agent layer forming means, will be explained below in more detail.

The blade 9 is held by a first blade holder 15, spacer 16 and second blade holder 17. The first blade holder 15 is rotatably supported around a shaft 18 and normally so urged by a plurality of compression springs (one spring is shown) 19 as to be rotated in a given direction. The blade 9 is pushed by the compression springs 19 against the developing roller 6.

The plurality of compression springs 19 are set to be lower than the spring constant of the thin leaf spring of which the blade 9 is made. Therefore, even if the abutting area of the blade 9 is worn out, there occurs almost no variation in abutting pressure of the blade 9, so that a toner layer can be maintained at all times at a better condition.

The blade 9 has its tip member 9 bonded to the forward end of the thin leaf spring 9A over substantially the whole length of the blade 9. The thin leaf spring 9A is made of stainless, beryllium copper, phosphor bronze, etc., and the tip member 9B is made of a rubber elastic body, or a resin, of 30° to 85° under the JIS-A hardness standard, such as silicone rubber or urethane.

The tip member 9B is semicircular in cross-section and has a diameter of about 0.5 to 6 mm. The arcuate or semicircular section of the tip member 9B is pushed, under a predetermined load, against the developing roller 6.

In the embodiment above, as the thin leaf spring 9A use was made of phosphor bronze 0.2 mm thick. However, a thin leaf spring 9A, about 0.1 to 2 mm-thick, can be used, depending upon the shape it takes. The tip member 9B can be mounted on the thin leaf spring 9A by many methods, such as fitting, sandwiching and so on, so long as an exact mounting is ensured.

The use of the support blade 9 of the structure as set out above can compensate for any inaccuracies, such as an uneven pressure (load), by the resiliency of the leaf spring 9A. Further, the blade 9 readily follows a motion of the developing roller 6 so that a toner layer can be formed positively as a uniform layer. This can be achieved by making the curvature of a front half of the tip member 9B a radial area of a size appropriate to restrict the amount of toner passed thereunder and positively setting the latter half area of the tip member in frictional contact with the developing roller 6. This enables the toner layer which is restricted by the front half area of the tip member 9B to be positively triboelectrically charged by the latter half area of the tip member.

At a location opposite the toner separation member 8, the mixer 11 is rotated in a direction of the arrow D in FIG. 1, that is, in a direction to scoop up the toner T within the toner storage section 2. The mixer 11 performs a double function of (1) supplying the toner T in the toner storage section 2 to the toner transfer roller 7 and (2) enabling the toner T which has been separated off the surface of the toner transfer roller 7 by the mesh network 8D of the toner separation member 8 and has been floated upward past the openings in the toner separation member 8 to be collected inside the toner storage section 2 and again supplied to the toner transfer roller 7 while mixing that toner with a fresh toner T.

The developing apparatus 1 thus structured will be explained below in conjunction with its development process.

The toner T in the toner storage section 2, while being agitated by the mixer 11, is sent to the toner transfer roller 7 and supplied by the toner transfer roller 7 to the developing roller 6. Some of the toner T is deposited on the developing roller 6 by a mechanical conveying force of the developing roller 6 and an electrostatic force resulting from the triboelectric charging caused between the surface of the developing roller 6 and the other associated member, and fed to the photosensitive drum.

The toner T deposited on the developing roller 6 and fed with the rotation of the developing roller reaches the blade 9 and, while being restricted in its amount to be transferred, triboelectrically charged due to the functional contact of the toner with the blade 9.

At this time, the blade 9 is located relative to the developing roller 6 such that the free end of the blade is in an "against" position to the rotation direction of the developing roller 6. It is evident to those skilled in the art that, according to the present invention, it is possible to employ the "with position as opposed to the "against" position as set out above. In the present embodiment, reversal development is adopted with the use of a negatively charged type organic photosensitive drum 5. In this case, a negatively charged toner is employed as the toner T and the blade is made of a material which is easier to negatively charge.

Further, the surface potential of the photosensitive drum 5 is set to be −350 to −700V and a development bias potential is applied to a metal shaft 6A of the developing roller 6 by connecting a development bias power source (−130 to −300V) through a protective resistor of 3 to 10 MΩ. According to the present invention it is possible to obtain a very high development sensitivity and hence to obtain a stable maximal density of about 1.4 at the surface potential of −500V and the bias potential of −200V.

The developing roller 6 is rotated in a "with" direction (a direction of an arrow B) and at a speed about 1 to 4 times that of the photosensitive drum 5 in a contacting (frictional) contact relation to the photosensitive drum, while being pressure-deformed to an extent that a contacting width (development nip) of about 1 to 5 mm is formed relative to the photosensitive drum 5. Since the toner T is subject to friction even at the development position and triboelectrically charged, it is possible to obtain a very sharp image of less fogging. The toner T′ remaining after development passes through the recovery blade 10 and is returned back to the apparatus body 4.

A developing/cleaning process (cleanerless process) type image forming apparatus 20 using the aforementioned developing apparatus as a developing/cleaning apparatus will be explained below with reference to FIG. 4.

Figure 4:
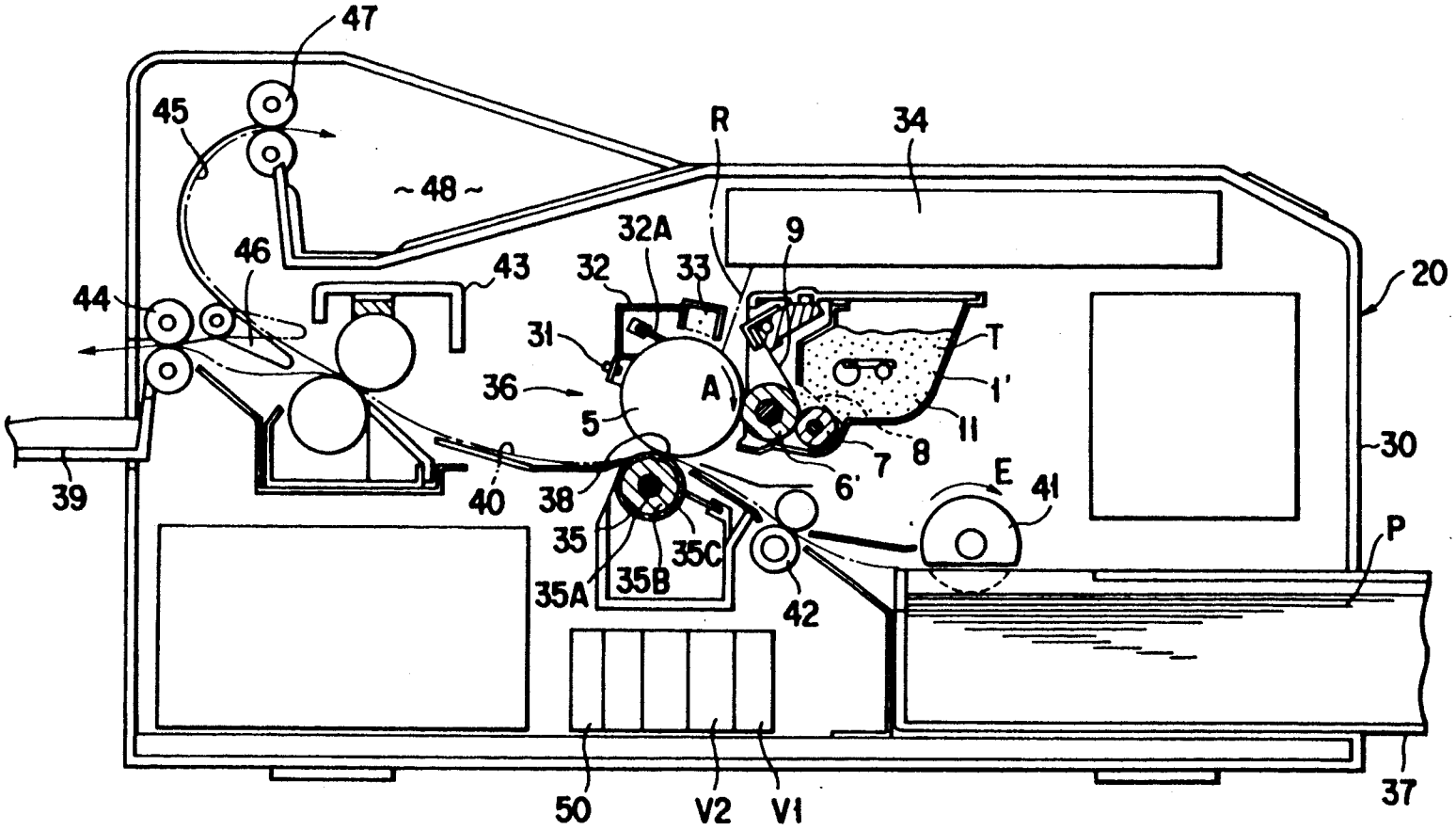
FIG. 4 is a front view diagrammatically showing an inner arrangement of a cleanerless process type image forming apparatus to which the developing apparatus of FIG. 1 is applied.

In FIG. 4 a photosensitive drum 5 is provided, as an image carrier, at a substantially middle area of an apparatus body 30 such that the drum 5 is rotatable in a direction of an arrow A.

An erasure lamp (charging means) 31, a disturbing unit (developing agent disturbing means) 32, a charger (charging means) 33, a laser unit (electrostatic latent image forming means) 34, a developing apparatus (developing/cleaning means) hereinafter referred to a developing/cleaning means apparatus 1,, and a transfer roller (transfer means) 35 are arranged around the photosensitive drum 5 such that these are located along the rotational direction of the photosensitive drum 5. An image forming means 36 is provided in this way which enables a toner image TI (see FIG. 1) to be formed as a developing agent image around the photosensitive drum 5.

The developing/cleaning apparatus 1' is substantially the same as the aforementioned developing apparatus 1 except that some component parts, such as a layer forming blade 9, are different from that of the development apparatus 1.

A paper sheet feeding cassette 37 is provided in the apparatus body 30 at one side and a paper sheet (a to-be-transferred material) P is taken out of the paper sheet feeding cassette 37. Within the apparatus body 30 a paper sheet conveying path 40 is provided which feeds the paper sheet P from the paper sheet feeding cassette 37 to a discharge tray 39 at the other side of the apparatus body 30 via an image transfer section 38 provided between the photosensitive drum 5 and the transfer roller 35 in the image forming means 36.

A pair of aligning rollers 42 are provided on an upstream side of the image transfer section 38 on the paper sheet conveying path 40 and, after the paper sheet P taken out of the paper sheet feeding cassette 37 has its end aligned through a paper feeding roller 41, are so timed as to enable the sheet P to be sent to the image transfer section 38. A fixing device 43 for fixing a toner image TI transferred to the paper sheet P and a pair of discharge rollers 44 through which the fixed paper sheet is discharged to the discharge tray 39 are provided on the downstream side of the image transfer section 38.

A gate 46 is provided between the fixing device 43 and the paper sheet discharge rollers 44 to guide the paper sheet P which is fixed by the fixing device 43 to an inversion conveying path 45 as required.

The paper sheet P guided to the invention conveying path 45 is discharged past a pair of paper sheet discharge rollers 47 into a paper discharge section 48 with an image-formed paper sheet side down. The paper sheet discharge section 48 is formed, as a recess section, on the upper surface side of the apparatus body 30.

The image forming apparatus 20 thus arranged will be explained below in conjunction with an image formation operation.

The photosensitive drum 5 is rotated in a direction as indicated by an arrow A in FIG. 4 and the outer surface of the photosensitive drum 5 is corona-discharged by the charger 33 to about −500 to −800 volts. A laser beam R is emitted by the laser unit 34 at the charged surface of the drum 5 so that an electrostatic latent image is formed on the outer peripheral surface of the photosensitive drum 5. The electrostatic latent image confronts the developing/cleaning apparatus 1' with the rotation of the photosensitive drum 5.

Here, the developing roller (hereinafter referred to as a developing/cleaning roller) 6' bearing a toner layer on its surface is brought in elastic contact with the photosensitive drum 5, while being deformed with a given nip width defined relative to the photosensitive drum, so that the toner T is deposited, as a toner image, on the electrostatic latent image on the drum 5. In this case, the toner T is deposited on the light-illuminted area on the drum and reversal development is carried out. The toner T is comprised of average particles of 8 to 15 μm in size and electrically charged to about −5 to −30 μc/g (microcoulomb/gram). A voltage of about −11 to −400 volts is applied to the developing/cleaning roller 6'.

The toner image TI on the drum after the developing step is fed to the image transfer section 38 which constitutes a transfer area confronting the transfer roller 35.

On the other hand, a paper sheet P is taken out of the paper sheet cassette 37 as the paper feeding roller 41 is rotated in a direction as indicated by an arrow E in FIG. 4, and sent toward the photosensitive drum 5 via the pair of aligning rollers 42 in synchronization with the rotation of the drum.

The paper sheet 35 is charged, by the transfer roller 35, to a positive polarity on its rear side. Therefore, the toner image TI on the surface of the drum 5 is electrostatically attracted to the paper sheet P for image transfer.

Here, the transfer roller 35 comprises, as in the case of the aforementioned developing roller 6, a metal shaft 35A, an elastic layer 35B and a surface conductive layer 35C. A voltage of +1000 to +2000 volts is applied by the DC power source 50 to the metal shaft 35A. A voltage is applied to the surface conductive layer 35C of $15^5$ to $10^9$ Ω.cm in conductivity through a conductive section comprised of a 30 to 40 w % conductive carbon-bearing silicone resin formed at each end of the transfer roller 35.

It has been found that under measurement by a JIS comparison method, the transfer roller 35, if comprised of a 25 to 50% flexible material against the total rubber hardness of the transfer roller 35, reveals a wide and proper allowance for a pressure force of the transfer roller 35 against the photosensitive drum 5.

After a transfer step, the paper sheet P is sent to the fixing device 43 where the toner T is fused and fixed to the paper sheet P, then discharged.

Some toner T remains as a small amount of residual toner T on the photosensitive drum 5 after a transfer step, and negative and positive electrostatic images remain after transfer of the toner T.

For the residual toner T or the electrostatic latent image, the following process is carried out. First, the negative latent image is eliminated by the erasure lamp 31. The residual toner T remains are decreased and, preferably but not necessarily, conveyed to the disturbing unit 32 where the toner is disturbed to assume a non-patterned state.

In the disturbing unit 32, an elastic brush 32A is brought into contact with the electrostatic latent image, causing the still remaining toner image and electrostatic latent image to be illegibly disturbed in a minute way, under a resultant mechanical/electrostatic force. In this case, a voltage of nearly above 400 bolts adequate to inject charges into the toner T is applied to the extent that the remaining toner T is not attracted from the surface of the photosensitive drum 5. At that time, that toner T once attracted to the elastic brush 32A is again repelled from the elastic brush 32A.

In this way, the electrostatic latent image is disturbed and most toner is scatteringly deposited over the surface of the photosensitive drum 5 and is hardly deposited within the charge disturbing unit 32. That is, the disturbing unit 32 does not function as an electrostatic recording unit, but functions as an auxiliary unit.

The scattered toner remaining on the surface of the photosensitive drum 5 is distributed in mist-like tiny particles and no longer possesses any character or image information.

The disturbed area is then conveyed to a charged position confronting the charger 33, where a corona discharge.

After charging, the surface of the photosensitive drum is subjected by the laser unit 34 to exposure and, after the formation of a new electrostatic latent image on the drum surface, the image on the drum surface again reaches a developing/cleaning position confronting the developing/cleaning apparatus 1'.

In the second cycle of the electrostatic latent image, no uneven exposure occurs over an exposed area (an imaged area to be deposited with the toner) and non-exposed area (a non-imaged area) on the drum surface because a residual toner after the transfer step has been substantially uniformly and fully scattered on the drum surface by the roller transfer. In the second cycle of development, therefore, a uniform toner image can be obtained due to a uniform potential created after the exposure step.

Here, the developing/cleaning roller 6', as already set out above in conjunction with the developing roller 6, possesses an elasticity of 30° to 40° as rubber hardness under the JIS rubber hardness measuring method and a conductivity of $10^2$ to $10^8$ Ω.cm. The developing/cleaning roller 6' is set in frictional pressure contact with the photosensitive drum and rotated at 1.5 to 4 times as great a relative speed as that of the photosensitive drum with a load of 20 to 150 g/cm applied as a linear load to the developing/cleaning roller 6' at which time a contacting width (nip) of 1 to 4 mm is created. At the nip area, the residual toner T and toner T on the developing/cleaning roller 6' are frictionally contact the drum, while being disturbed, and cleaning capability is enhanced due to the creation of a strong frictional force at that area. Since the developing agent is formed of the toner T only, there is no possibility that a poor-quality image will emerge due to the emergence of streak and sweeping marks.

At the non-exposed area, an attraction force resulting from the developing bias exceeds that of the photosensitive drum 5 and, therefore, the residual toner T deposited on the photosensitive drum 5 is sequentially attracted toward the developing/cleaning apparatus 1' for collection. By applying a developing bias level intermediate between the residual potential on the exposed area and a potential on the non-exposed area to the developing/cleaning roller 6', a fresh toner T is deposited from the developing/cleaning 6' onto the exposed area while, at the same time, the residual toner T on the non-imaged area is attracted from that area toward the developing/cleaning roller 6' for collection. At that time, less residual toner T is deposited and distributed by the disturbing unit 32 in tiny mist-like particles, thus allowing the residual toner T to be effectively collected by the developing/cleaning apparatus 1'. Therefore, no adequate toner collection occurs.

In this way, the photosensitive drum 5 is rotated/used in a multiple cycle mode, obtaining recorded paper sheet. After developing/cleaning steps, the toner image TI is transferred to the paper sheet P at an area confronting the transfer roller 35. The same process is thus carried out repetitively.

The developing/cleaning roller 6' can collect the residual toner T and, at that time, any paper dust which is deposited on the drum surface after the paper sheet P has been separated. The paper dust contains normally mineral additives, such as talc and Kaolin, of about 2 to 8 microns. These additives, together with the residual toner T, are collected by the developing/cleaning roller 6' and the developing/cleaning roller 6' is brought into frictional contact with a toner transfer roller 7 rotated in a direction as indicated by an arrow C.

The toner transfer roller 7 is the same as that of the preceding embodiment with respect to their shape and function. In order for the toner T in the toner hopper 3 to be conveyed toward the developing/cleaning roller the side during 6 developing/cleaning operation in the case where the present apparatus is used as the developing/cleaning apparatus 1', the bias voltage on the toner transfer roller 7 is made about 50 to 200 volts higher than that on the developing/cleaning roller 6' in terms of their absolute value. By so doing, more toner T can be supplied at an accelerated rate to the developing/-cleaning roller 6', so as to maintain an enhanced image density level on the developing/cleaning apparatus 1'.

In a timing corresponding to the so-called non-image-forming time and image-to-image time interval at the paper sheet feeding interval, sheet discharging, and other steps, a bias voltage to be applied to the toner transfer roller 7 is switched to a 0 to +100 volts lower level (absolute value) so as to positively transfer the toner T and paper dust from the developing/cleaning roller 6' toward the toner transfer roller 7 side while being separated off the roller 6'. By so doing, the toner T and paper dust otherwise inseparable by a mechanical separation are collected onto the toner transfer roller 7.

In the prior art, the toner T deposited on the toner transfer roller 7 is left as it is. According to the present invention, such toner is sequentially separated by the aforementioned toner separation member 8 from the toner transfer roller 7. The separated toner T is returned back to a toner separation section 2 and, together with the toner T in the toner storage section 2, mixed by a mixer 11. At each switching of a bias voltage on the toner transfer roller 7, the toner is again fed from above the toner transfer roller 7 onto the developing/cleaning roller 6'.

The aforementioned bias power source arrangement is the same as that of the preceding embodiment where the bias power sources $V_1$, $V_2$ are employed for the aforementioned developing apparatus 1. The power source corresponding to $V_1$, if switched by the aforementioned image forming process to −0 to −400 volts, and most preferably −100 and −300 volts, is found most advantageous, noting that this is achieved at the developing bias $V_2$ of −200 volts. If, in this case, the developing bias is varied, then adjustment is naturally made to maintain a corresponding relative potential difference, as set out above.

As set out above, the collected toner T or mixed foreign substance is not accumulated on the developing/cleaning roller 6' and, once being collected in the toner storage section 2 and mixed with the fresh toner T, is again used for development. It is, therefore, possible to eliminate a "hysteresis" phenomenon on the developing/cleaning roller 6' and also eliminate a hysteresis difference between the unspent toner and the fresh toner within developing/cleaning apparatus 1'. It is possible to prevent an image defect resulting from such a hysteresis difference between the unspent toner and the fresh toner in a toner container, that is, to prevent any abrupt variation or nonuniformity of an image obtained.

According to the present invention, a mesh network 8D comprised of very fine lines, etc. and constituting part of the toner separation member 8 is set in frictional contact with the toner transfer roller 7, thus allowing the toner to be separated by a lighter frictional contact force than by a means used in the prior art. In the neighborhood of that frictional contact area, a rotating body, such as a mixer 11, can be properly located from behind the mesh network 8D, thus allowing the unspent toner which is separated off the toner transfer roller 7 and floatingly moved back to be properly mixed with the fresh toner T.

For a developing apparatus employing a toner transfer roller of better transfer properties but having an elastic member, such as rubber, liable to be mechanically injured, if use is made of the toner separation member 8 which, as already set up above, can alleviate a mechanical stress in particular, then the developing apparatus can assure a longer service life according to the present invention.

Figure 5:
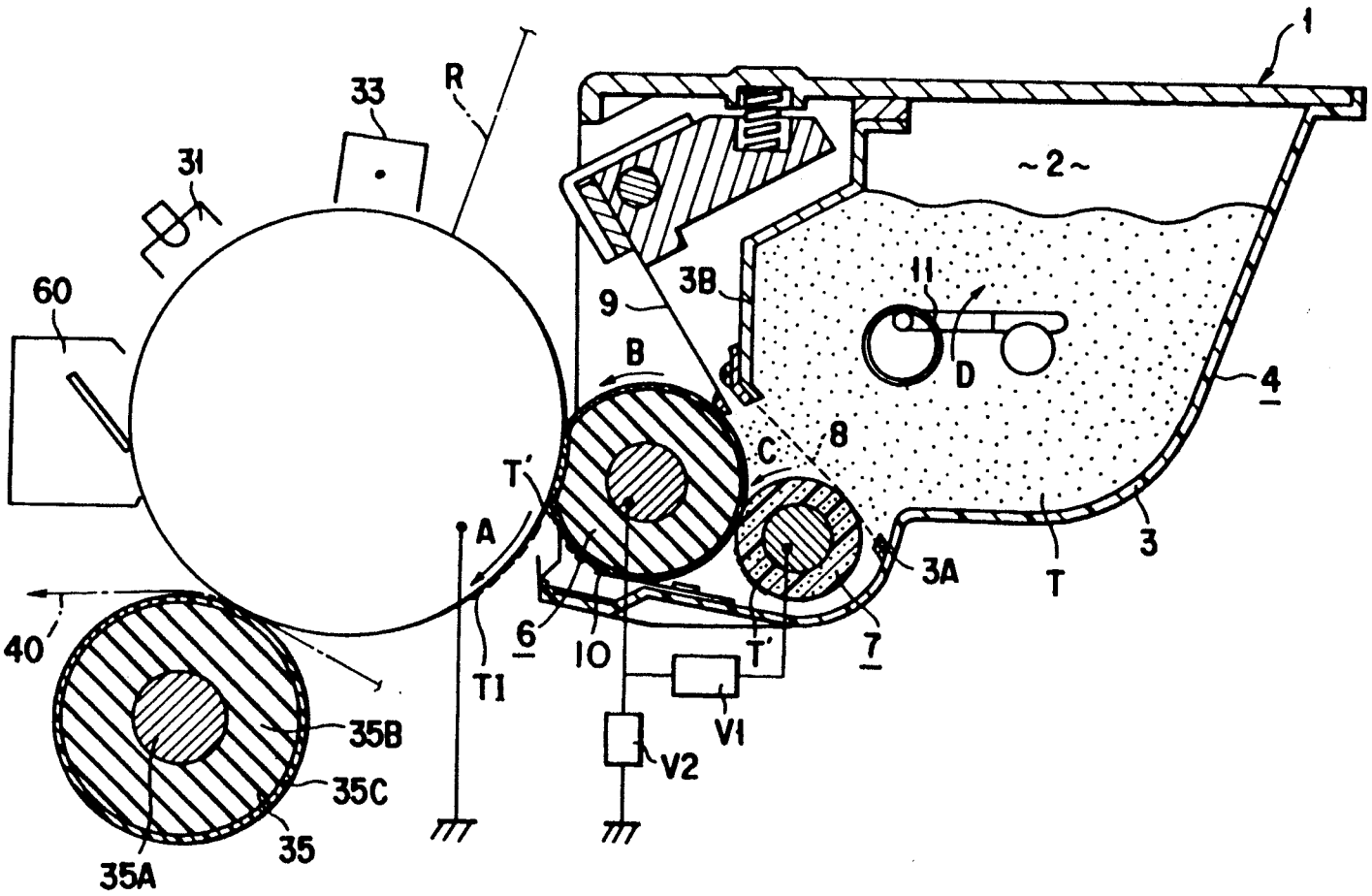
FIG. 5 is a diagrammatic view showing a major section of a cleaner-equipped image forming apparatus to which the developing apparatus of FIG. 1 is applied.

Although the developing apparatus 1 of the present invention has been explained as being applied to the cleanerless process type image forming apparatus for enabling the developing and cleaning steps to be simultaneously carried out, the present invention is not restricted thereto and can also be applied to an image forming apparatus equipped as a cleaning device with a cleaner 60 as shown in FIG. 5 and adapted to separately effect the developing and cleaning steps.

In FIG. 5, the same reference numerals are employed to designate parts or elements corresponding to those shown in FIGS. 1 to 4 and any duplicate explanation is, therefore, omitted for brevity.

The present invention is not restricted to the aforementioned embodiment and various changes or modifications of the invention can be made without departing from the spirit and scope of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing apparatus for developing a latent image on an image carrier using a one-component developing agent, comprising:

first supplying means in contact with the image carrier, for supplying the developing agent to the latent image on the image carrier and simultaneously removing the developing agent remaining on the image carrier;

storing means for storing the developing agent;

second supplying means formed of a roller having a metal shaft and a flexible expanded foam member around the metal shaft, the flexible expanded foam member being formed of a flexible expanded polyurethane foam layer having a conductivity of below $10^9$ Ω.cm, a density of 0.45 g/cm$^2$ and 50 to 60 cells/mm, the second supplying means in contact with the first supplying means, for supplying the developing agent from the storing means to the first supplying means and removing the developing agent remaining on the first supplying means; and removing means, in contact with the second supplying means, for removing the developing agent back into the storing means.

2. A developing apparatus for developing a latent image on an image carrier, using a one-component developing agent, comprising:

a developing/cleaning roller, in contact with the image carrier, for supplying the developing agent to the latent image on the image carrier so as to develop the latent image, while simultaneously removing the developing agent remaining on the image carrier;

storing means for storing the developing agent;

a transfer roller, in contact with the developing/cleaning roller, for transferring the developing agent from the storing means to the developing/cleaning roller and for collecting the developing agent remaining on the developing/cleaning roller;

voltage applying means for applying a higher bias voltage to the transfer roller than to the developing/cleaning roller by 50–200 V at a development time, thereby to permit the developing/cleaning roller to receive a developing agent, and applying a lower bias voltage to the transfer roller than to the developing/cleaning roller by 0–100 V at a non-development time, thereby to permit the transfer roller to collect the developing agent remaining on the developing/cleaning roller; and removing means for removing the developing agent, which has been recovered from the developing/cleaning roller to the transfer roller, from the transfer roller, and returning the removed developing agent to the storing means.

* * * * *